United States Patent [19]

van der Hoeven

[11] Patent Number: 4,966,363

[45] Date of Patent: Oct. 30, 1990

[54] MUSCULAR DEVELOPMENT METHOD

[76] Inventor: Martin A. van der Hoeven, 2726 Loker Ave., West, Carlsbad, Calif. 92008

[21] Appl. No.: 360,133

[22] Filed: Jun. 1, 1989

Related U.S. Application Data

[63] Continuation-in-part of Ser. No. 156,404, Feb. 16, 1988, Pat. No. 4,848,740.

[51] Int. Cl.[5] ..... A63B 23/02

[52] U.S. Cl. ..... 272/93; 272/118; 272/134

[58] Field of Search ..... 272/72, 73, 93, 117, 272/118, 123, 134, 132; 128/25 R

[56] References Cited

U.S. PATENT DOCUMENTS

| | | | |
|---|---|---|---|
| 1,577,809 | 3/1926 | Randall | 272/72 |
| 1,983,911 | 12/1934 | Luppert | 272/72 X |
| 3,558,130 | 1/1971 | Anderson | 272/72 |
| 4,336,934 | 6/1982 | Hanagan et al. | 272/117 X |
| 4,616,825 | 10/1986 | Anderson | 272/134 |
| 4,632,393 | 12/1986 | van Noord | 272/134 |
| 4,684,126 | 8/1987 | Dalebout et al. | 272/134 |
| 4,687,197 | 8/1987 | Larsson et al. | 272/72 |
| 4,733,859 | 3/1988 | Kock et al. | 272/132 X |
| 4,757,998 | 7/1988 | Landin | 272/123 |
| 4,802,462 | 2/1989 | Reiss et al. | 128/25 R |

FOREIGN PATENT DOCUMENTS

| | | | |
|---|---|---|---|
| 117935 | 8/1918 | United Kingdom | 272/72 |

*Primary Examiner*—Robert W. Bahr

*Attorney, Agent, or Firm*—Henri J. A. Charmasson

[57] ABSTRACT

The present invention discloses a method for strengthening the abdominal musculature. The method primarily copmrises isometric contraction of the abdominal musculature while the operator is seated in a specific position. The positioning entails a generally seated position of the operator in which the forearms are generally orthogonal to the arms, the arms are generally parallel to the thoracic spine, the legs are extended, the hip is flexed, the thoracic and lumbar spine are slightly flexed. While in this position, the operator contracts the abdominal musculature by pulling with the hands on a tow line, and pushing the feet against a foot stop, involuntarily tensing the abdominal musculature. Additional strengthening of the abdominal musculature is achieved by positioning the pelvis on the seat such that the pelvis is posteriorly rotated, by allowing the chest to move forward against a chest restraint, and by taking a breath and holding it by doing isometric contractions of the abdominal musculature.

4 Claims, 1 Drawing Sheet

MUSCULAR DEVELOPMENT METHOD

PRIOR APPLICATION

This is a continuation-in-part of application Ser. No. 07/156,404 filed Feb. 16, 1988 which is now U.S. Pat. No. 4,848,740.

FIELD OF THE INVENTION

This invention relates to the increasingly popular field of body development and exercise activity for the purpose To increase tone, size, and definition of musculature. More specifically it relates to isometric exercise methods and devices.

BACKGROUND OF THE ART

It is well known that the abdominal musculature is difficult to isolate and strengthen. Many hours and years on exercise is generally necessary to produce a significant effect of the abdominal musculature. The prior art discloses three categories of muscular development methods and apparatuses as follows:

(1) Full range of motion;

(2) Limited range of motion;

(3) Compression devices.

The full range of motion devices are typified in U.S. Pat. Nos.; 4,290,597; 3,558,130; and 4,616,825. Each of these devices relates to a modification of the well known sit-up. Such inventions suffer from two major drawbacks. First, many muscle groups are indiscriminately exercised in addition to exercising of the target abdominal muscles. This results in slow development of the musculature. Second, the flexion of the lumbar and thoracic spine over a significant range of motion may exacerbate previous low back and other injuries.

Limited range of motion inventions are typified by Schleffendorf, U.S. Pat. No. 4,290,597, generally involving in an exercise called an "abdominal crunch." While such inventions may isolate the abdominal musculature, the positioning of the operator is such that maximal benefit to the operator is not achieved. Specifically in such inventions, either the legs of the operator are not extended at the knee, or the feet are not pressing against a foot stop, or the operator is leaning back, or the operator is not pulling with his arms, or the hips are not flexed, or the pelvis is not posteriorly tilted. Research performed at the direction of the inventor of the present invention has demonstrated that if any of these factors is not present, the benefit to the abdominal musculature of the "crunch" exercise will be suboptimal.

SUMMARY OF THE INVENTION

It is an object of the present invention to enable strengthening of the abdominal musculature without placing unnecessary stress upon the low back. This is achieved by isometric contraction of the abdominal musculature which necessarily precludes excessive lumbar movement.

It is a second object of the present invention to maximize the strengthening effect of the abdominal exercise on the abdominal musculature. The present invention achieves this objective through specific positioning of the operator during the exercise. The specific positioning achieves a balanced development of each of the abdominal muscles.

BEST MODE OF CARRYING OUT THE INVENTION

Figure 1:
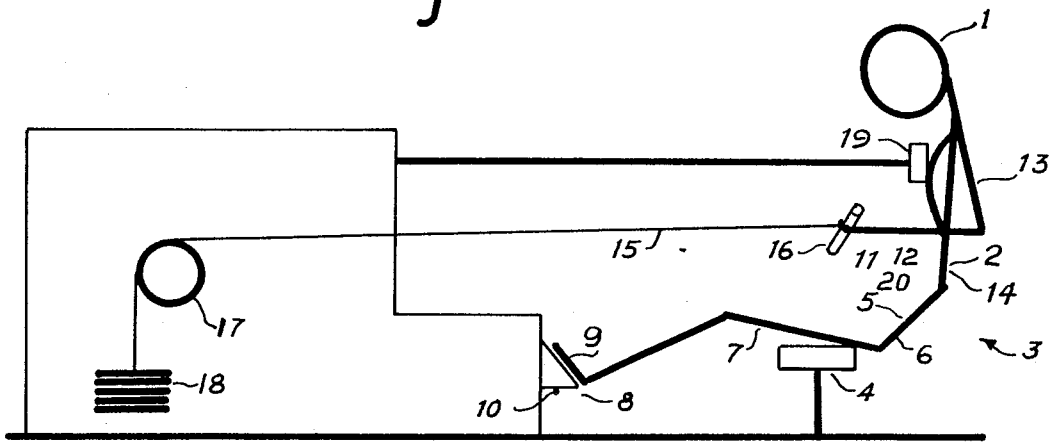
FIG. 1 illustrates an operator utilizing the exercise method disclosed herein.

Referring now to FIG. 1, the operator, 1, is positioned in a seated position, 3, on a seat, 4. The seated position, 3, is such that the operator, 1, has a posteriorly tilted pelvis, 5, a slightly flexed thoracic spine, 14, and a slightly flexed lumbar spine, 2. The operator, 1, has flexed hips, 6, extended legs, 7, and feet, 8, which are pushing, 9, against a foot stop, 10. The operator, 1, has externally rotated hands, 11, which are pulling on a tow line, 15. The operator has forearms, 12, arms, 13, and a thoracic spine, 14. The forearms, 12, are generally orthogonal to the arms, 13. The arms, 13, are generally parallel to the thoracic spine, 14. The tow line, 15, has a handle, 16, which enables the operator, 1, to pull on the tow line, 15, while maintaining the hands, in an externally rotated positioning. The tow line, 15, extends over a pulley, 17, and is attached to a weight stack, 18. A chest restraint, 19, prevents the thoracic and lumbar spine,, 2, from excessive flexion.

In the execution of the method as herein described, the operator, 1, is positioned slightly off the edge of the seat, 4, thereby posteriorly tilting the pelvis, 5. The operator, 1, then leans forward and grabs the handle, 16, in such a manner that his hands, 11, are externally rotated. In this position, the operator, 1, has a slightly flexed thoracic spine, 14, and slightly flexed lumbar spine, 2. If the thoracic spine, 14, and the lumbar spine, 2, are not slightly flexed, then the chest restraint, 19, is moved to a position such that the thoracic spine, 14, and the lumbar spine, 2, are slightly flexed. While in the seated position, 3, the operator, 1, extends the legs, 7, and pushes the feet, 8, against the foot stop, 10. If the legs, 7, are of such length that extending the feet, 8, do not touch the foot stop, 16, then the seat, 4, is moved closer or farther away from the foot stop, 10, such that the feet, 8, touch the foot stop, 10. The operator, 1, then draws handle, 10, towards the thoracic spine, 14, until the forearms, 12, are generally orthogonal to the arms, 13, and the arms, 13, are generally parallel to the thoracic spine, 14. This causes the weight stack, 18, to be raised and to bias the tow line, 15, away from the operator. The above described method causes contraction of the abdominal musculature, 20. Exercise of the abdominal musculature, 20, is further enhanced by voluntary contraction of the abdominal musculature, 20, by the operator, 1 while holding the above-described position.

In an alternative embodiment of the method of the present invention, the weight stack, 18, can be replaced by any effective biasing means including a spring or a magnetic break. The tow line, 15, can be replaced by an suitable pulling means including a rope, chain, or strap. The handle, 16, can be replaced by any suitable grabbing means including a loop, brace, or mere friction applied to the tow line, 15.

What is claimed is:

1. A method for exercising one's abdominal musculature which comprises:

assuming a seated position over a substantially horizontal structure with legs fully extended in a substantially horizontal direction;

pushing one's feet against a substantially vertical stop;

tilting one's pelvis posterially while resting the thorax forwardly against an immobile barrier, and holding one's thoracic spine area in a forwardly bent position; and pulling and holding a horizontally tensioned tow-line with both hands, bringing one's arms to a substantially vertical position with elbows bent.

2. The method of claim 1 which further comprises the step of repeatedly contracting and relaxing one's abdominal muscles while holding said tension line.

3. The method of claim 2 which further comprises the step of holding one's breath during said contracting and relaxing.

4. The method of claim 3, wherein the step of tilting the pelvis comprises balancing one's hips over a back edge of said horizontal structure.

* * * * *